US006722486B2

(12) United States Patent
Shibata et al.

(10) Patent No.: US 6,722,486 B2
(45) Date of Patent: Apr. 20, 2004

(54) BILL HANDLING MACHINE

(75) Inventors: Yasushi Shibata, Seto (JP); Manabu Takenaka, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 100 days.

(21) Appl. No.: 10/067,535

(22) Filed: Feb. 7, 2002

(65) Prior Publication Data

US 2002/0121422 A1 Sep. 5, 2002

(30) Foreign Application Priority Data

Mar. 1, 2001 (JP) ..... 2001-057350

(51) Int. Cl.[7] ..... G07F 7/04; B65H 5/00; B65H 1/02; B07C 5/00

(52) U.S. Cl. ..... 194/206; 271/3.04; 271/149; 209/534

(58) Field of Search ..... 271/264, 145, 271/162, 163, 3.03, 3.04, 177, 149; 194/206, 207, 302; 209/534

(56) References Cited

U.S. PATENT DOCUMENTS 4,883,183 A * 11/1989 Kimura et al. ..... 209/534
4,928,230 A * 5/1990 Kawamura et al. ..... 700/244
6,334,610 B1 * 1/2002 Minamishin et al. ..... 271/3.04
6,533,261 B2 * 3/2003 Katou et al. ..... 271/3.12

FOREIGN PATENT DOCUMENTS

JP 11-175801 7/1999 ..... G07D/9/00
JP 2001-97566 A * 4/2001 ..... B65H/1/14
JP 2001-312760 A * 11/2001 ..... G07D/9/00

* cited by examiner

*Primary Examiner*—Donald P. Walsh
*Assistant Examiner*—Mark J Beauchaine
(74) *Attorney, Agent, or Firm*—McDermott, Will & Emery

(57) ABSTRACT

The bill input/output part has a movable pusher plate and a front plate and a partition plate movable between the pusher plate and the front plate to store bills, which are to be returned or paid, between the pusher plate and the partition plate, and also includes a controller to vary the distance between the pusher plate and the partition plate according to the number of bills to be stored. Bills can be arranged upright. After the bills stored between the pusher plate and the partition plate are extracted, the distance between the partition plate and the front plate is widened. This operation makes it easy to re-enter bills in the space. When a remaining bill, such as a folded bill is detected, the space between the pusher plate and the partition plate is widened so that the user can easily be notified of a failure to extract.

13 Claims, 11 Drawing Sheets

BILL HANDLING MACHINE

BACKGROUND OF THE INVENTION

The present invention relates to a bill handling machine that separates, transfers and stores bills, and more particularly to a bill handling machine that makes it easy for the user to extract bills transferred to the bill input/output part, and that can inform the user that some bills left overlooked remain in the bill input/output part and also notify when to re-enter the bills when necessary.

Of conventional bill handling machines used in financial institutions, a type of machine is well known which is composed of a bill input/output slot, a transfer path, a discriminator, a temporary holder, bill storage cases, and bills to be received or paid are stored in the bill input/output space as disclosed in JP-A-11-175801, for example.

SUMMARY OF THE INVENTION

With the above-mentioned conventional bill handling machine, there is a problem that the bills transferred to the bill input/output slot are not arranged in line when they are returned, and therefore the bills may not be extracted smoothly. Another problem is that there is not means to notify the user when to re-enter the bills once placed in the bill input/output part nor means to warn about bills the user forgot to take out.

The object of the present invention is to solve the above problems and provide a bill handling machine which makes it easy for the user to extract the bills transferred to the bill input/output part and which can warn against forgetting to extract the bills and also notify when to re-enter the bills without increasing the cost of the machine or reducing the function of the bill input/output part.

To achieve the above object, in the present invention, there is particularly provided means to arrange the bills in line, which are to be extracted, in the bill input/output part. More specifically, the bill input/output part includes a movable pusher plate, a fixed front plate, and a partition plate movable between the pusher plate and the front plate, the bills to be paid are stored in a space between the pusher plate and the partition plate, and also includes control means to vary the distance between the pusher plate and the partition plate (the bill output space) according to the number of bills to be stored. Accordingly, the bills can be arranged upright between the pusher plate and the partition plate, making it easy to take out the bills.

In addition, there is provided means to notify when to re-enter the bills that the user extracted. More specifically, there is provided means to widen the distance between the partition plate and the front plate (the bill input space) when the bills stored between the pusher plate and the partition plate have been extracted. Accordingly, the more widely opened bill input space between the partition plate and the front plate makes it easy to re-enter bills in place of reject bills.

Further, there are provided two means to notify the user that there are some bills, which have not been extracted and are remaining in the bill input/output part. One is means to detect a bill that does not measure up to a regular size or a folded bill after the normal bills stored between the pusher plate and the partition plate have been extracted, and the other is means to widen the distance between the pusher plate and the partition plate when a bill is found remaining which is undersized or folded. By these means, the user easily becomes aware of the bill that has not been extracted, thus reducing chances of users walking out unaware of the overlooked bill.

DESCRIPTION OF THE EMBODIMENTS

The bill handling machine according to the present invention will be described with reference to the accompanying drawings.

Figure 1:
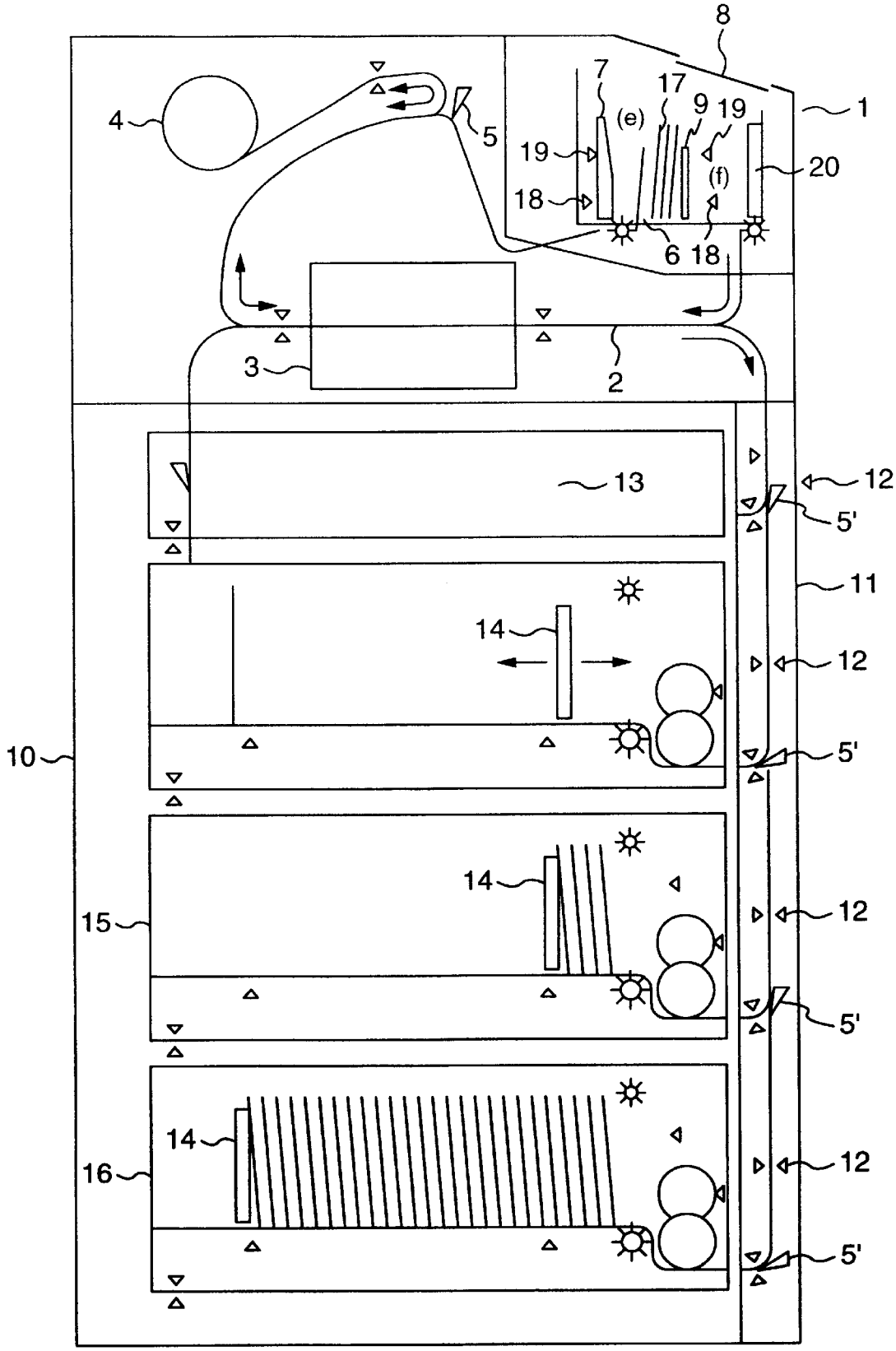
FIG. 1 is a schematic diagram of a bill handling machine.

FIG. 1 is a schematic diagram for explaining an embodiment of the bill handing machine according to the present invention. Description will first be made of the outline of the receiving and paying transactions of bills by the bill handling machine in FIG. 1.

Firstly, a receiving transaction by the bill handling machine in FIG. 1 is discussed. In a receiving transaction, when the user puts bills in the bill input/output part 1, the bill input/output part separates the bills one from the other, and sends out the bills on the transfer path 2. The bills sent out on the transfer path 2 are discriminated by the discriminator 3 in terms of denominations and authenticity, and then the storing places are decided into which they are transferred.

The bills which are judged to be rejects (reject bills) are transferred to a reject bill stacker 6 by a switch-over of a gate 5, and are stored and arranged in line in a space ((e) in FIG. 1, hereafter referred to as the bill output space (e)) between the pusher plate 7 located at a backward stage and the partition plate 9 located at a middle stage of the bill input/output part 1. Subsequently, as the shutter 8 is opened, the user is notified that there is a bill in the reject bill stacker 6 between the pusher plate 7 and the partition plate 9 and the user is prompted to extract the bills stored and arranged in line in the bill output space (e).

When the bills stored in the bill output space (e) between the pusher plate 7 and the partition plate 9 of the bill input/output part 1 are extracted by the user, this is detected by a bill presence/absence sensor 18 of the bill input/output part and the partition plate 9 is retracted toward the pusher plate side, thereby widening a space ((f) in FIG. 1, hereafter referred to as the bill input space (f)) between the partition plate 9 and the front plate 20 located at the forward stage of the bill input/output part 1, by which the user is notified that it is possible to re-enter the bills.

If it is found by the bill presence/absence sensors A 18 and B 19 of the bill input/output part that a bill has not been extracted (sensor A 18: dark; sensor B 19: dark) or a folded bill remains (sensor A 18: dark; sensor B 19: light), the bill output space (e) between the pusher plate 7 and the partition plate 9 is made wider so that any remaining bill can be noticed easily, and thus the user is notified that there is some bill yet to be extracted or a folded bill.

Meanwhile, a bill judged authentic by the discriminator 3 is caused by a switch-over of the gate 5 to advance in a direction toward a wind-round type temporary holder 4 which stores the bill. When the user requests that the bills stored in the temporary holder should be returned, the temporary holder 4 rotates in reverse from the direction in which the bills were wound, and the bills are sent out on the transfer path 2 in a reverse sequence. The bills sent out on the transfer path 2 are transferred to the reject bill stacker 6 by a switch-over of the gate 5. The pusher plate 7 and the partition plate 9 are controlled in the same manner as described above.

On the other hand, if the user requests that those bills should be received, while the respective pusher plates 14 are moved in the ten-thousand-yen bill storage case 15 and the thousand-yen bill storage case 16 so that the bills can be stored in the ten-thousand-yen bill storage case 15 and the thousand-yen bill storage case 16, the wind-round type temporary holder 4 is rotated in reverse from the direction in which the bills were wound and are sent out on the transfer path 2. The bills sent out on the transfer path 2 are monitored by passage detecting sensors 12 on the transfer path 2 and the storage cases of the bills are switched over by the gates 5 and the gates 5' at suitable timing. By the switch-over of the gates, the bills judged authentic by the discriminator 3 are stored, ten-thousand-yen bills in the ten-thousand-yen bill storage case 15 and thousand-yen bills in the thousand-yen bill storage case 16. The bills judged to be five-thousand-yen bills, two-thousand-yen bills or reject bills are put away in the reject box 13. When the storage cases of bills of specified denominations are full, even ten-thousand-yen bills and thousand-yen bills, which were judged authentic, are put away in the reject box 13.

When any of the ten-thousand-yen bill storage case 15, the thousand-yen bill storage case 16 and the reject box 13 is full as a result of repetition of receiving transactions, the person in charge opens the door 11 of the housing 10 and takes out the ten-thousand-yen bill storage case 15, the thousand-yen bill storage case 16 or the reject box 13 which is full, and after taking out the bills, puts the box back in the housing 10 closes the door 11, and resumes the operation.

Description will next be made of a paying transaction by the bill handling machine in FIG. 1.

In a paying transaction, the bill handling machine sends out the bills on the transfer path 2 by separating the bills one from the other out of the ten-thousand-yen bill storage case 15 or the thousand-yen bill storage case 16 of denominations specified by the user, and also judges the denominations and authenticity of the bills by the discriminator 3. As a result of judgment, the bills judged to be reject bills are taken up temporarily by the wind-round type temporary holder 4, and only those bills judged authentic are transferred to the bill input/output part 1 and stored in the bill output space (e). After this, the bills judged to be rejects and taken up by the wind-round type temporary holder 4 are sent out one after another and stored in the reject box 13 by a switch-over of the gate 5.

After this, the shutter 8 is opened, and the user is prompted to take out the bills put in the bill output space (e) of the bill input/output part 1. If it is found by the bill presence/absence sensors A 18 and the B 19 that there remains a bill yet to be extracted or a folded bill in the bill output space (e), the bill output space (e) between the pusher plate 7 and the partition plate 9 is widened so that the user can easily take notice of the overlooked bill or the folded bill and extract it. After a paying transaction has been repeated a number of times, the ten-thousand-yen bill storage case 15 or the thousand-yen bill storage case 16 will become empty. When this happens, the person in charge opens the door 11 of the housing 10, takes out the ten-thousand-yen bill storage case 15 or the thousand-yen bill storage case 16 which is empty, and after filling the case with bills, he or she puts the case back into the housing 10, closes the door 11 and resumes the operation. Description has been made of the basic operations of the receiving transaction and the paying transaction according to the present invention.

Figure 2:
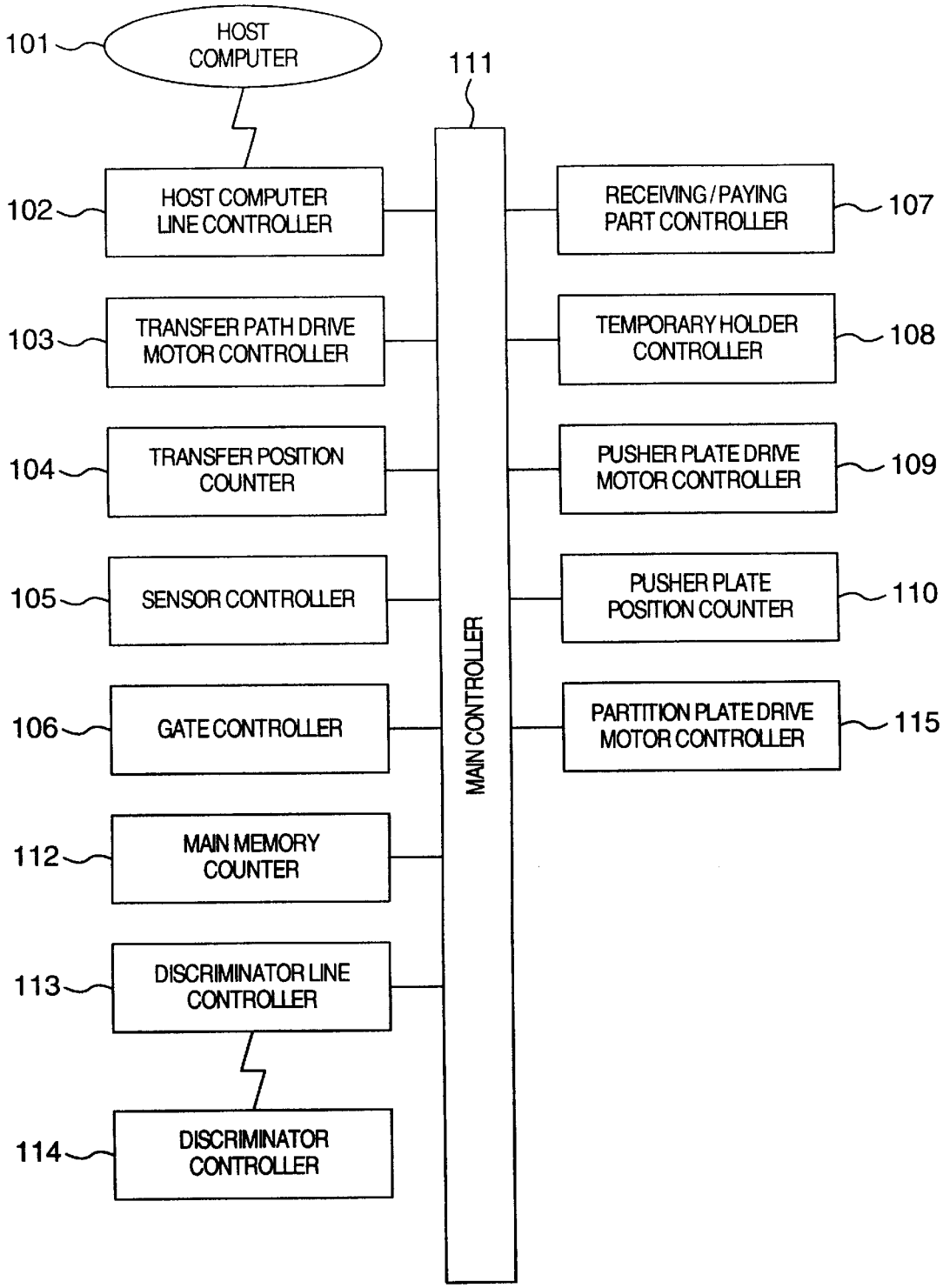
FIG. 2 is a control block diagram of the bill handling machine.

FIG. 2 is a block diagram for explaining the control section of the bill handling machine shown in FIG. 1.

As shown in FIG. 2, the control section is composed of a host computer line controller 102, a transfer path drive motor controller 103, a transfer position counter 104, sensor controller 105, a gate controller 106, a bill input/output part controller 107, a temporary holder controller 108, a pusher plate drive motor controller 109, a pusher plate position counter 110, a main memory 112, a discriminator controller 114, a discriminator line controller 113, a partition plate drive motor controller 115, and a main controller 111 controlling all those component parts.

The functions of the controllers will be described. The host computer line controller 102 controls the reception of messages from the host computer 101 to the bill handling machine specifying operations, and also controls the transmission of messages from the main controller 111 to the host computer 101 regarding the process results. In response to commands from the main controller 111, the transfer-path drive motor controller 103 controls the motors driving the transfer path shown in FIG. 1. The transfer position counter 104 counts the amount of travel of the transfer path 2 shown in FIG. 1. The sensor controller 105 monitors the states of the respective sensors (the passage detecting sensor 12, the bill input/output part bill presence/absence sensors A 18 and B 19, for example) shown in FIG. 1, and communicates signals to the main controller 111.

The gate controller 106, based on an operation pattern specified by the main controller 111, monitors the transfer state of bills by signals from the passage detecting sensors 12 and by the amount of travel of the transfer path 2 shown in FIG. 1, and switches over the gate 5 and the gates 5'. The bill input/output part controller 107, in response to commands of the main controller 111, controls the drive of the motors to receive or pay out bills in the bill input/output part 1.

The temporary holder controller 108, in accordance with a command from the main controller 111, controls the drive of the motor driving the wind-round type temporary holder 4 shown in FIG. 1. The pusher plate drive motor controller 109, in accordance with a command from the main controller 111, controls the drive of the motors moving the pusher plates 14 that push bills in the ten-thousand-yen bill storage case 15 and the thousand-yen bill storage case 16 shown in FIG. 1. The pusher position counter 110 counts the amount of travel of the pusher plate 14 shown in FIG. 1.

The discriminator line controller 113 controls the reception of discrimination results of the discriminator 3 and also controls the transmission of operation commands. The discriminator controller 114, in accordance with a command from the main controller 111, controls the discriminator 3. The partition plate drive motor controller 115, in accordance with a command from the main controller 111, controls the drive of the motor for moving the partition plate 9 to hold bills in the bill input/output part 1 shown in FIG. 1.

Figure 3:
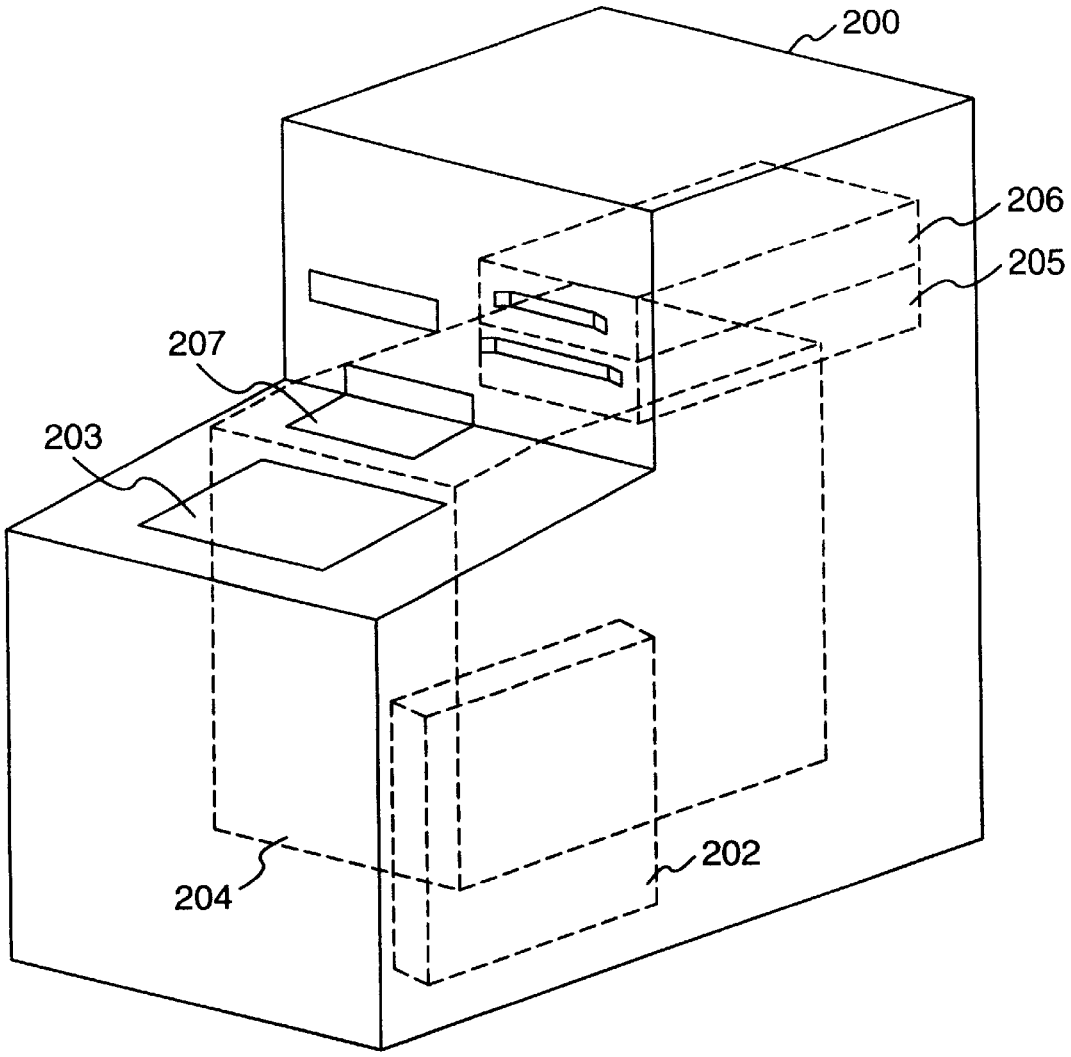
FIG. 3 is a diagram showing a general appearance of an automatic cash handling machine.

FIG. 3 shows a general appearance of an automatic cash handling machine incorporating the bill handling machine shown in FIG. 1. As shown in FIG. 1, the automatic cash handling machine 200 includes an operation part 203, which displays information supplied to the user when making a transaction, or on which the user enters transaction information, a bill handling machine 204 (FIG. 1), a detailed statement issuing mechanism 205 for issuing a detailed transaction statement in a receiving or paying transaction, a card handling mechanism 206 for handling magnetic stripe cards, and a main-body controller 202 for controlling all those components. A bill input/output space 207 serving as the bill input/output part 1 (See FIG. 1) of the bill handling machine 204, which the user uses to put in or receive money, is provided at the front face of the automatic cash handling machine 200.

Figure 4:
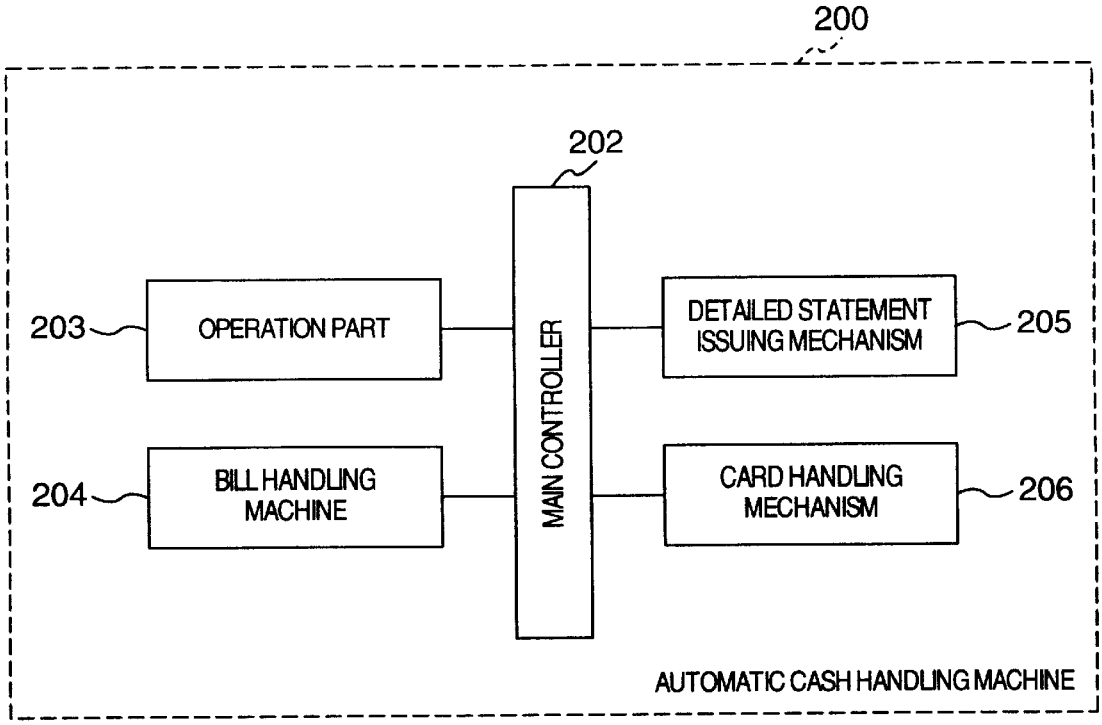
FIG. 4 is a control block diagram of the automatic cash handling machine.

FIG. 4 is a control block diagram of the automatic cash handling machine 200, shown in FIG. 3, and illustrates that the operation part 203, the bill handling machine 204, the detailed statement issuing mechanism 205, and the card handling mechanism 206 are electrically connected to the main-body controller 202 for communication of control signals.

Figure 5:
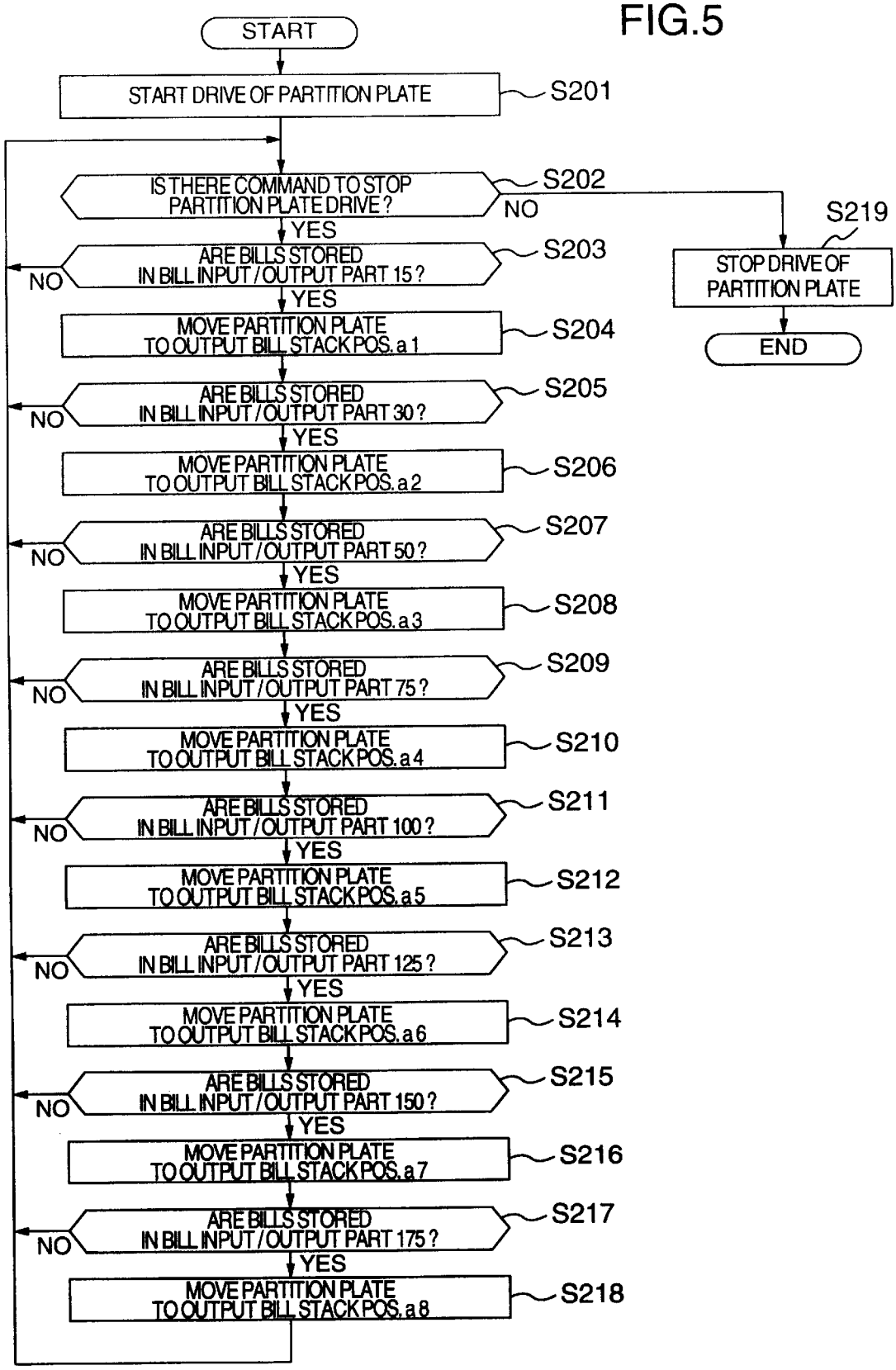
FIG. 5 is a flowchart for explaining a bill storing process from a temporary holder to a bill input/output part.
Figure 6:
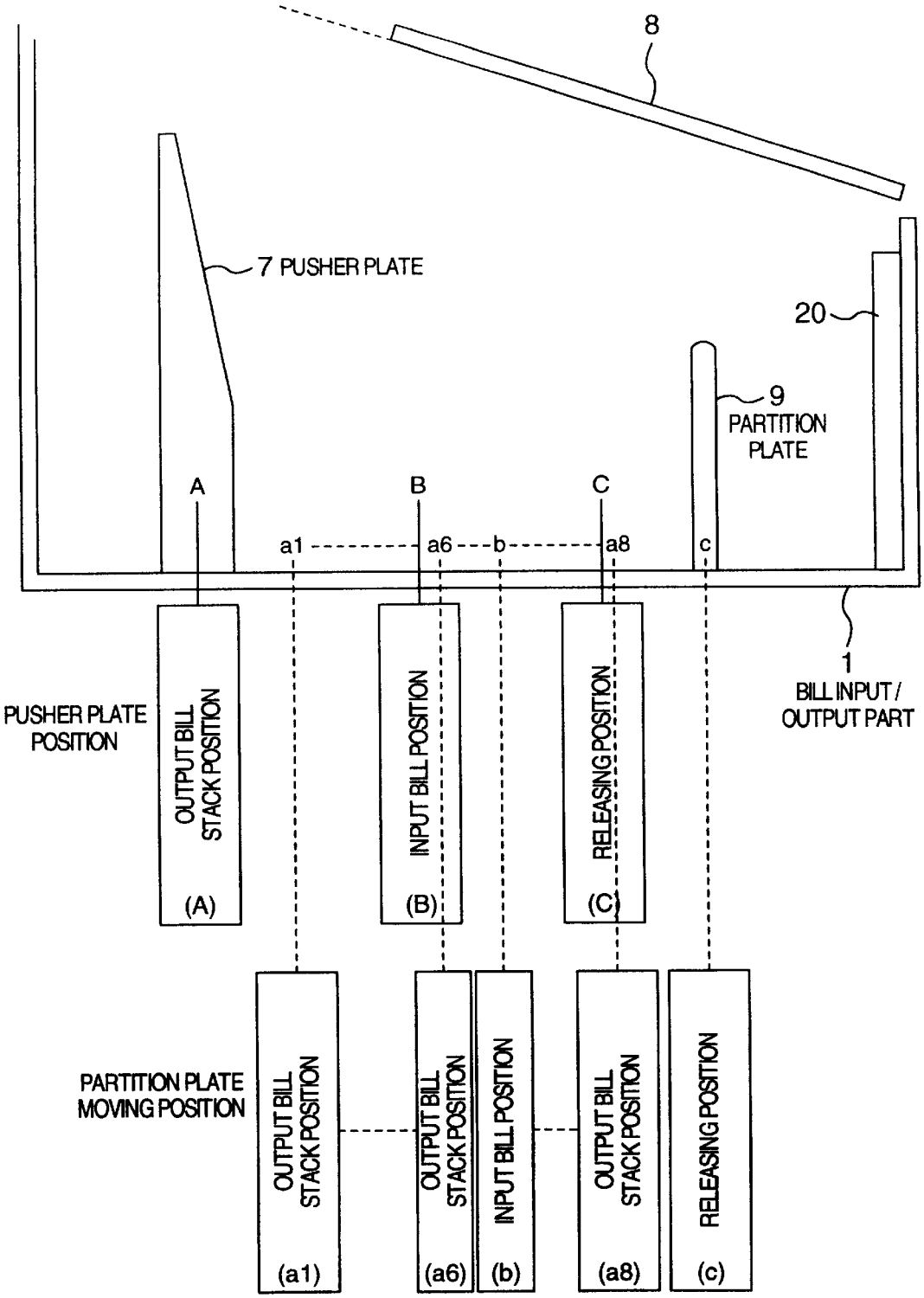
FIG. 6 is a diagram for explaining the positional relation between the pusher plate and the partition plate when storing bills in the bill input/output part (for payment), when receiving bills and when manually releasing the bills.

First, a process of storing bills (bill paying process) according to the present invention will be explained. FIG. 5 is a flowchart for explaining a process of storing bills from the temporary holder 4 to the bill input/output part 1. FIG. 6 is a diagram for explaining the positional relations of the pusher plate 7 and the partition plate 9 when storing bills in the bill input/output part 1 (for payment), when receiving bills and when manually releasing bills. In FIG. 6, the position of the pusher plate 7 during a bill storing process (when paying bills) is denoted by an output bill stack position A, and the positions, to which the partition plate 9 is moved according to the stored amount of bills to be paid, are denoted by output bill stack positions (a1), (a2), (a3) and so on. On the other hand, when receiving bills, the position of the pusher plate 7 is denoted by an input bill stack position B and the position of the partition plate 9 is denoted by an input bill position (b). When manually releasing bills, the position of the pusher plate 7 is denoted by a releasing position C and the position of the partition plate 9 is denoted by a releasing position (c).

Figure 7A:
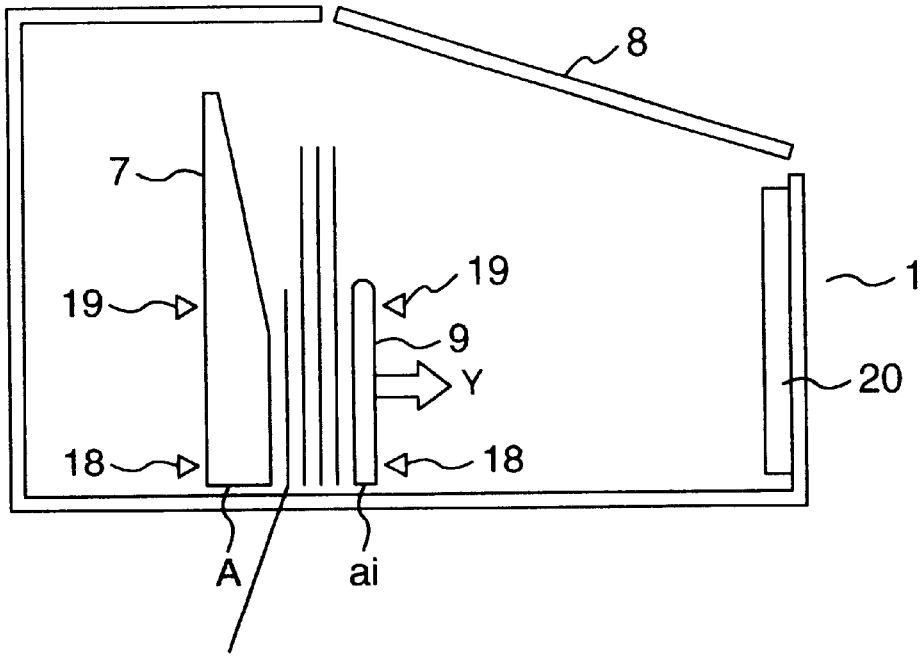
FIGS. 7A and 7B are diagrams showing states when bills are stored by moving the partition plate forward.
Figure 7B:
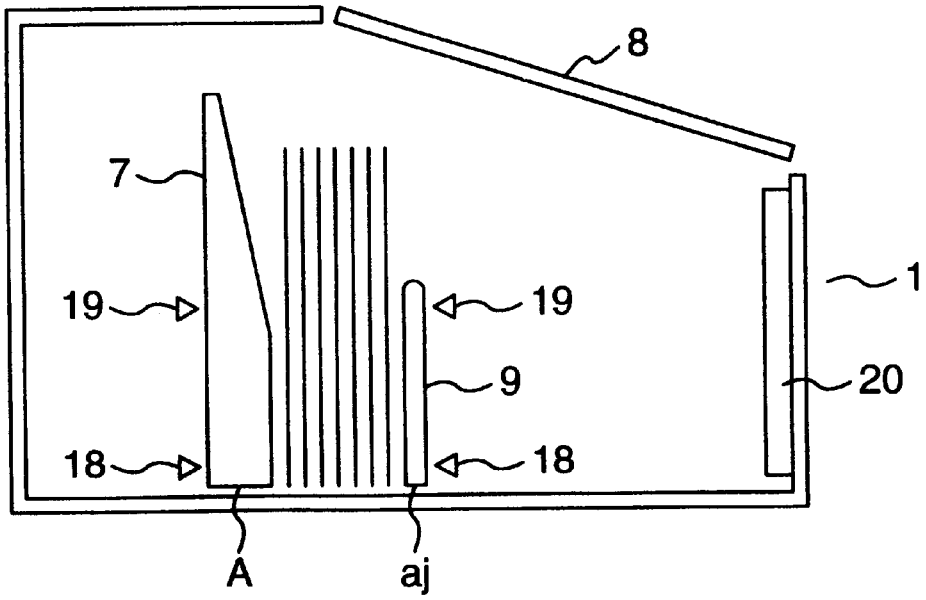

FIGS. 7A and 7B are diagrams showing states when bills are stored by moving the partition plate forward. The arrow mark Y in FIG. 7A indicates the moving (advancing) direction of the partition plate 9 when storing bills. FIG. 7B shows the state after the bills have been placed in the bill input/output part.

Description will be made by following the steps of the flowchart in FIG. 5 with reference to FIGS. 1–4 and 6, and 7.

As shown in the flowchart of FIG. 5, in the process of storing bills from the temporary holder 4 to the bill input/output part 1, by a command from the main controller 111, the partition plate drive motor controller 115 starts to drive the partition plate 9 (Step S201). The main controller 111 checks the number of bills transferred to the bill input/output part 1 by sensor information sent from the sensor controller 105 (Step S203).

If, for example, 15 or more bills having been transferred to the bill input/output part 1 is detected (Yes in Step S203), the main controller 11 directs the partition plate drive controller 115 to make the partition plate 9 advance to the output bill stack position (a1) (Step S204), then the main controller 111 checks whether or not 30 or more bills have been transferred to the bill input/output part 1 (Step S205).

If 30 or more bills having been transferred to the bill input/output part 1 is detected (Yes in Step S205), the partition plate drive motor controller 115 is directed to make the partition plate 9 advance to the output bill stack position (a2) (Step S206), and then the main controller checks whether or not 50 or more bills have been transferred to the bill input/output part 1 (Step S207).

If 50 or more bills having been transferred to the bill input/output part 1 is detected (Yes in Step S207), the partition plate drive motor controller 115 is directed to make the partition plate 9 advance to the output bill stack position (a3) (Step S208), and then the main controller 111 checks whether or not 75 or more bills have been transferred to the bill input/output part 1 (Step S209).

If 75 or more bills having been transferred to the bill input/output part 1 is detected (Yes in Step S209), the partition plate drive motor controller 115 is directed to make the partition plate 9 advance to the output bill stack position (a4) (Step S210), then the main controller 111 checks whether or not 100 or more bills have been transferred to the bill input/output part 1 (Step S211).

If 100 or more bills having been transferred to the bill input/output part 1 is detected (Yes in Step S211), the partition plate drive motor controller 115 is directed to make the partition plate 9 advance to the output bill stack position (a5) (step S212), and the main controller 111 checks whether or not 125 or more bills have been transferred to the bill input/output part 1 (Step S213).

If 125 or more bills having been transferred to the bill input/output part 1 is detected (Yes in Step S213), the partition plate drive motor controller 115 is directed to make the partition plate 9 advance to the output bill stack position (a6) (Step S214), and then the main controller 111 checks whether or not 150 or more bills have been transferred to the bill input/output part 1 (Step S215).

If 150 or more bills having been transferred to the bill input/output part 1 is detected (Yes in Step S215), the partition plate drive motor controller 115 is directed to make the partition plate 9 advance to the output bill stack position (a7) (Step S216), and then the main controller 111 checks whether or not 175 or more bills have been transferred to the bill input/output part 1 (Step S217).

If 175 or more bills having been transferred to the bill input/output part 1 is detected (Yes in Step S217), the partition plate drive motor controller 115 is directed to make the partition plate 9 advance to the output bill stack position (a8) (Step S218), and then the main controller 111 checks if a stop command is sent to the partition plate drive motor controller 115 from the host computer (Step S202).

Note that if a decision at Step S203, S205, S207, S209, S211, S213, S215 or S217 is "N", in other words, if a specified number of bills are not transferred, the process returns to Step S202 and the main controller 111 checks if a stop command is sent to the partition plate drive motor controller 115 from the host computer.

When a command to stop the partition plate drive is received (Yes in Step S202), the drive of the partition plate 9 is stopped, thus terminating the bill storing process (Step S219).

In the present invention, according to an increase in the number of bills transferred from the temporary holder 4 and stored in the bill input/output part 1, the bill output space (e) between the pusher plate 7 and the partition plate 9 is made gradually wider by driving the partition plate 9 from the output bill stack position (al) to the output bill stack position (a8) (toward the user side). In this way, the stored bills are arranged upright so that the user can hold the bills more easily. Note that, needless to say, the numbers of bills detected in Steps S203, S205, S207, S209, S211, S213, S215 and S217 are only for the purpose of showing examples, and may be changed arbitrarily. Also, it goes without saying that the above description applies to the bill paying transactions in which bills are transferred from the bill storage cases to the bill input/output part 1.

Figure 8:
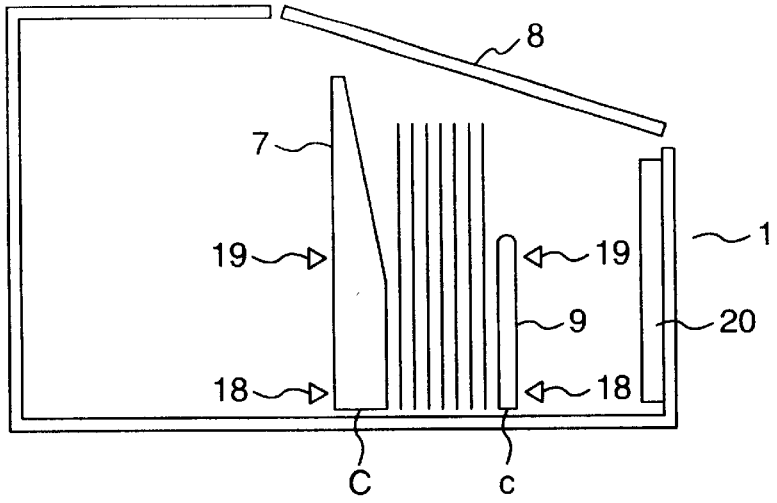
FIG. 8 is a diagram showing the bills stored in the bill input/output part and waiting to be extracted.

Subsequently, the pusher plate 7 is moved forward to the manual releasing position (C) and the partition plate 9 to the manual releasing position (c) while holding the bills arranged upright between them, and the bills are placed in the bill input/output part in the state of waiting to be extracted as shown in FIG. 8. It ought to be noted that the manual releasing position (C) of the pusher plate 7 changes with the number of bills to be staked.

Description will be made of the process of re-entering bills.

Figure 9:
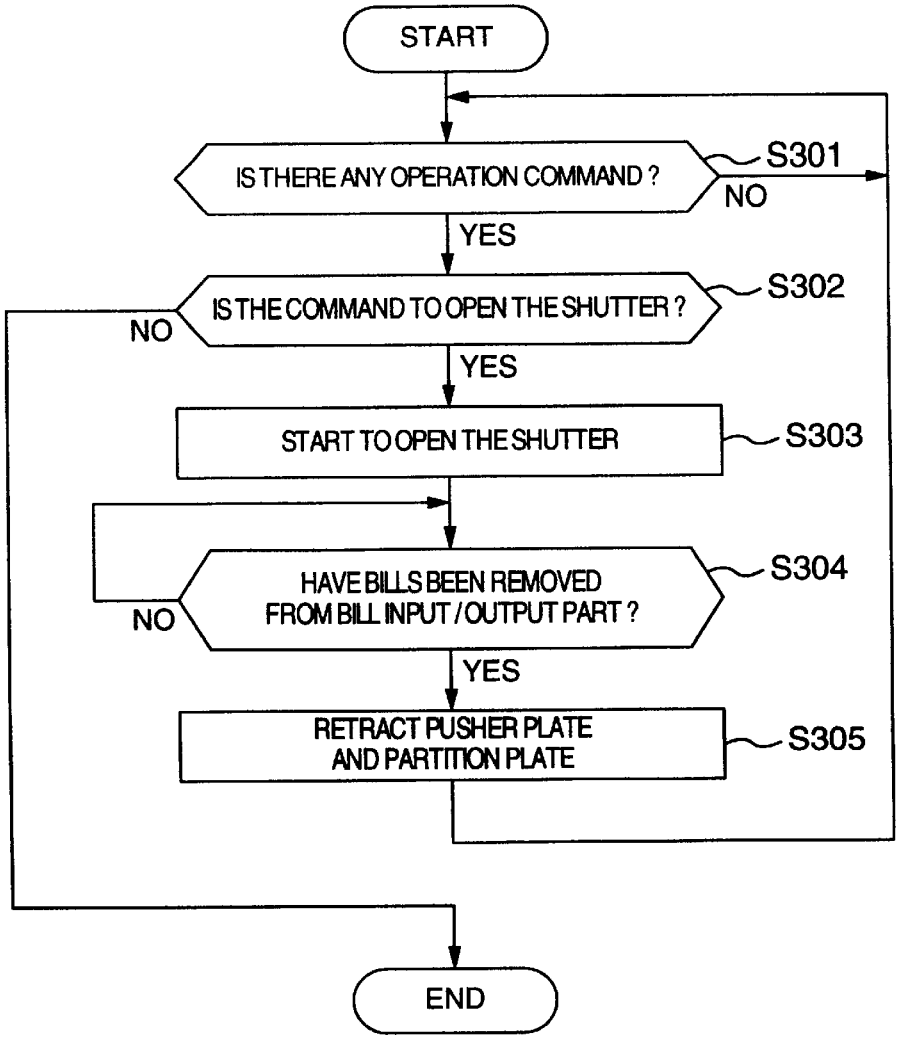
FIG. 9 is a flowchart for explaining the process of re-entering bills.
Figure 10:
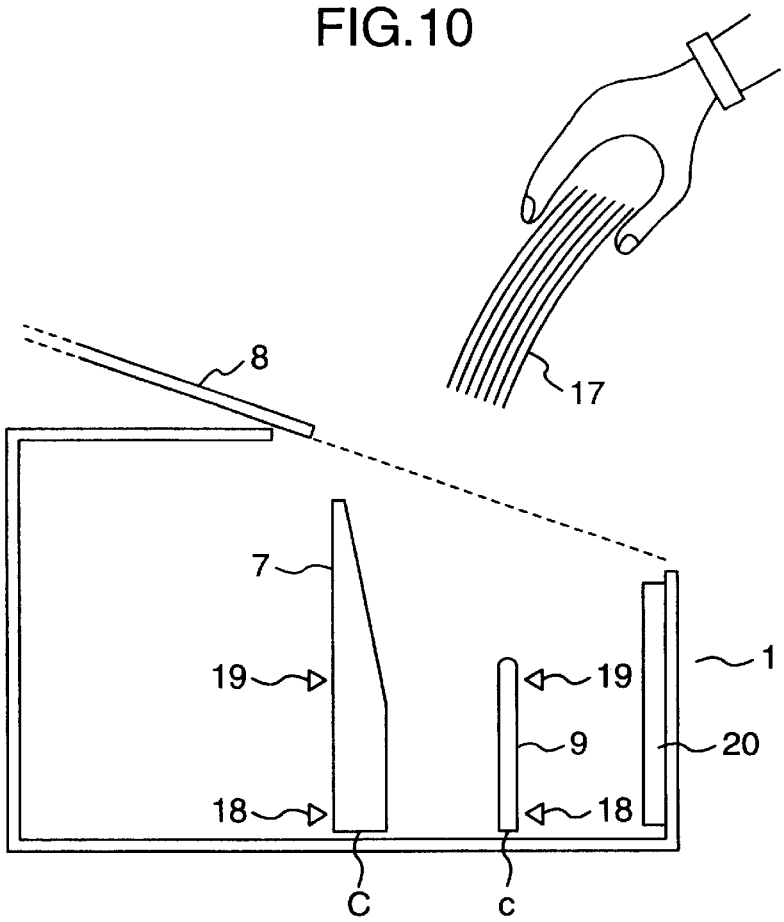
FIG. 10 is a diagram showing that the shutter was opened when the bills were in the wait state for extraction (FIG. 8) and the bills are extracted from the bill input/output part.
Figure 11:
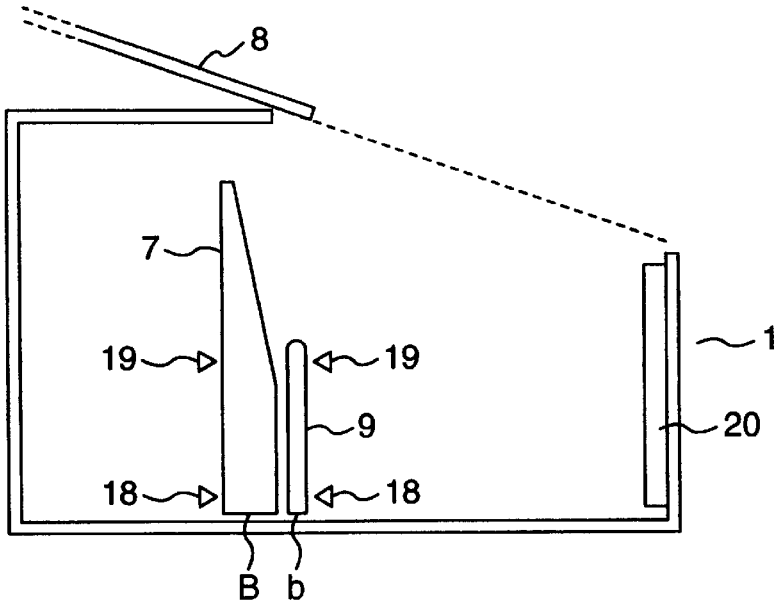
FIG. 11 is a diagram showing the bill input/output part is in the wait state for re-entering bills after the bills were extracted.

FIG. 9 is a flowchart for explaining a process for re-entering bills, FIG. 10 is a diagram showing the way in which bills 17 are extracted the bill input/output part 1 after the shutter 8 has been opened under the state that the bills set in the bill input/output part 1 are in the wait state for extraction (refer to FIG. 8), and FIG. 11 is a diagram showing the wait state for re-entering bills after the bills have been extracted.

Referring to FIGS. 1–4, 10, and 11, description will be made by following the steps of the flowchart in FIG. 9.

As shown in the flowchart in FIG. 9, the main controller 111 is watching out for an operation command from the host computer 101 (Step S301). When a command is issued from the host computer 101 (Yes in Step S301), if this command is to open the shutter (Yes in Step 302), the main controller 111 directs the bill input/output part controller 107 to open the shutter (Step S303).

By this command, the shutter 8 is opened and under the condition that the bills are ready for extraction, the bills are extracted from the bill input/output part 1 as shown in FIG. 10. The main controller checks whether or not the bills 17 have been extracted from the bill input/output part 1 by sensor information from a bill presence/absence sensor A 18 at the bill input/output part, which communicates with a sensor controller 105 (Step S304).

If removal of all bills from the bill input/output part is detected from sensor information sent by the bill presence/absence sensor A 18 at the bill input/output part 1, in other words, if the sensor information is that light falls on the sensor (Yes in Step S304), a pusher plate 7 is moved back to an input bill position (B) and a partition plate 9 is moved back to an input bill position (b) as shown in FIG. 11 (Step S305), and after this, the process returns to the step S301 and the main controller 111 again checks if there is a command sent from the host computer 101, and when a command sent from the host computer 101 is not a command to open the shutter (No in Step S302), the process is finished.

According to this embodiment, when all bills have been extracted from the bill paying position (e), the pusher plate 7 and the partition plate 9 in the bill input/output part 1 are retracted to the input bill positions (B) and (a), respectively, so that the bill input space (f) becomes wider, by which the user is made to know that this is time to enter bills.

Description will now be made of a process of extracting a bill that is left overlooked and a process of re-entering a bill that does not measure up to a regular size (a folded bill, such as one folded in half) according to the present invention.

Figure 12:
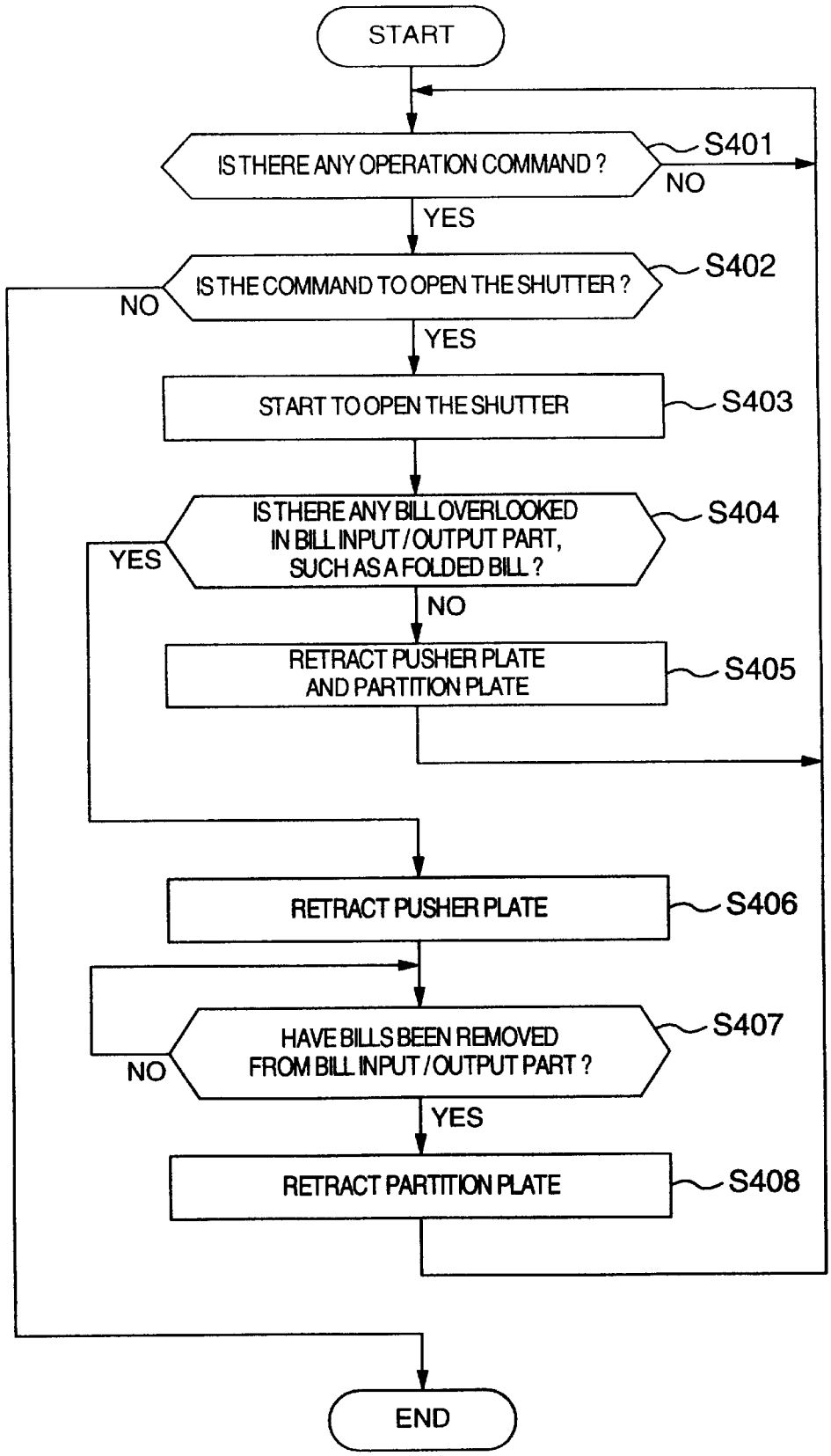
FIG. 12 is a flowchart for explaining the bill-extraction and re-entering process.
Figure 13:
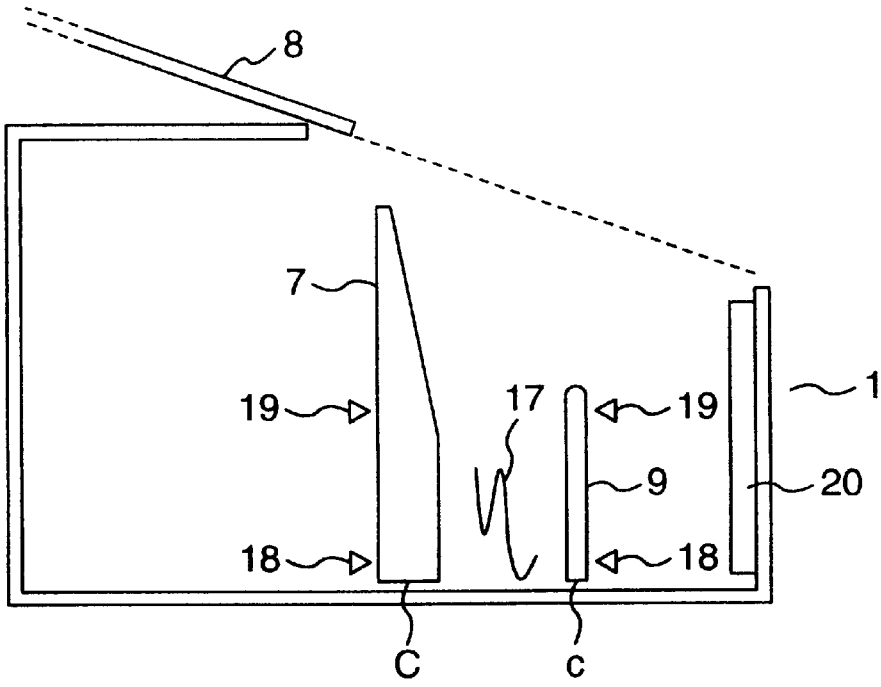
FIG. 13 is a diagram showing an undersize bill (folded in half, for example) is in the wait state for extraction.
Figure 14:
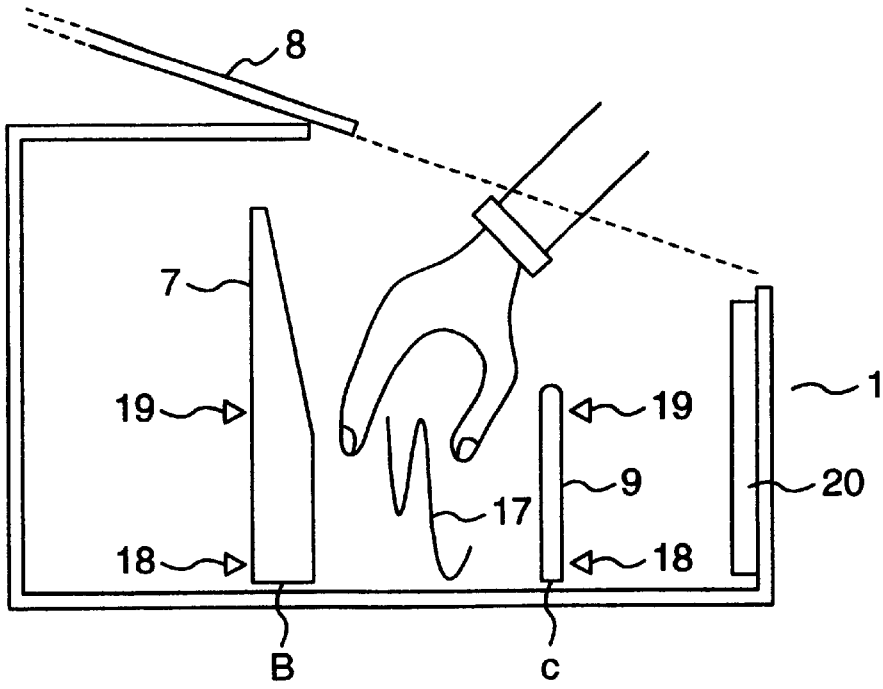
FIG. 14 is a diagram showing that the bill output space is widely opened and an undersize bill (a folded bill, for example) is being extracted from the bill input/output part.

FIG. 12 is a flowchart for explaining the bill-extraction and re-entering process according to this embodiment, FIG. 13 is a diagram showing a bill not measuring up to a regular size (such as a bill folded in half) and waiting to be extracted, and FIG. 14 is a diagram showing the under-size bill 17 (such as a bill folded in half) being extracted from bill input/output part 1 by widening the bill output space (e).

Referring to FIGS. 1–4, 13 and 14, description will be made by moving from one step to another in the flowchart of FIG. 12.

As shown in FIG. 12, the main controller 111 is watching out for an operation command from the host computer 101 (Step S401). When a command is issued from the host computer (Yes in Step S401), if this command is to open the shutter 8(Yes in Step 402), the main controller 111 directs the bill input/output part controller 107 to open the shutter (Step S403), putting the bill input/output part in the bill state as shown in FIG. 7B. The main controller 111 monitors the state of bills in the bill input/output part (FIG. 7B) from sensor information transmitted by the sensor controller 105 to find whether or not bills have been extracted (Step S404).

When the bill presence/absence sensors A 18 and B 19 at the bill input/output part 1 both detect light and therefore detect no bill because either it is overlooked or measures less than a regular size (a folded bill, for example) (No in Step S404), the pusher plate 7 of the bill input/output part 1 is retracted to the input bill position (B) and the partition plate 9 to the input bill position (b) (Step S405). Those steps are the same as Steps S304 and S305 in the flowchart of FIG. 9 (See FIGS. 10 and 11).

When the bill presence/absence sensors A 18 and B 19 at the bill input/output part 1 both detect the darkness and therefore detect a bill that failed to be extracted and remains in the bill input/output part 1, though omitted in the flowchart of FIG. 12, under this condition the bill is waiting to be extracted as in the decision of Step S304 is N in FIG. 9, and the pusher plate and the partition plate are both retracted to secure the bill output space. After removal of the bills (No in Step S404), the bill presence/absence sensors A 18 and B 19 of the bill input/output part 1 detect light. Therefore, as described above, the pusher plate 7 of the bill input/output part 1 is retracted to the input bill position (B) and the partition plate 9 to the input bill position (b) (Step S405).

When the bill presence/absence sensor A 18 detects the darkness and the bill presence/absence sensor B 19 detects light and therefore the presence of a bill not measuring up to a regular size (folded in half, for example) in the bill input/output part 1 is detected (No in Step S404), the pusher plate 7 is retracted to the input bill position (B) while the partition plate 9 is held at the release position (c) in the bill input/output part (Step S406), thus widening the bill output space (e) to bring the user's attention to the presence of a folded bill, for example, and urge him or her to extract the bill (Step S405). FIG. 13 shows the above-mentioned condition at this time.

After this, the main controller 111 monitors the bill input/output part 1 to see whether or not a remaining bill, such as a folded bill, has been extracted (Step S407). When the removal of the remaining bill is detected (No in Step S407), the partition plate 9 is retracted to the input bill position (b) (the pusher plate is at the input bill position (B) at this moment). Thus, after all bills have been extracted, the bill input space (f) is made wider, by which the user is made to know that this is time to throw a bill in.

As mentioned above, after the bill extraction process, if there remains a bill not measuring up to a regular size (such as one folded in half), the distance between the pusher plate 7 and the partition plate 9, in other words, the bill output space (e) is made wider, by which the user is reminded of an overlooked bill and is prompted to extract the remaining bill.

In the above embodiment, an example of position control of the pusher and partition plates is shown, but the present invention is not limited to this example. For example, it is possible to employ any position control so long as control is performed when widening the bill output space between the pusher plate and the partition plate according to the number of bills when bills are arranged, or when widening the bill output space between the pusher plate and the partition plate to remind the user of an overlooked bill, or when widening the bill input space between the partition plate and the front plate to tell the user when to put bills in.

The embodiments have been described separately referring to different modes of transactions. However, it is, needless to say, possible to make combinations of the embodiments.

As has been described, according to the present invention, bills transferred to the bill input/output part can be arranged and it becomes easy for the user to extract bills. When the user re-enter the bills returned to the bill input/output part, the distance (the bill input space) between the partition plate and the front plate in the bill input/output part can be made wider, by which the user is made to know when to re-enter bills. By widening the distance (the bill output space) between the pusher plate and the partition plate, the user can be reminded that there remains a bill that failed to be extracted in the bill input/output part.

What is claimed is:

1. A bill handling machine for handling bills comprising:

a bill input/output part for receiving and paying bills;

a discriminator for discriminating bills;

a plurality of storage cases for storing bills received from said bill input/output part according to discrimination results by said discriminator or storing bills to be paid from said bill input/output part;

a temporary holder for temporarily storing bills received from said bill input/output part;

wherein said bill input/output part includes a pusher plate movably located at a backward stage thereof, a front plate arranged at a forward stage thereof, and a partition plate movably located between said pusher plate and said front plate so that bills transferred from said temporary holder or from said plurality of storage cases are stored between said pusher plate and said partition plate, wherein said bill input/output part further includes control means for varying a distance between said pusher plate and said partition plate according to a number of bills to be stored therebetween; and a bill extraction detector for detecting extraction of bills stored between said pusher plate and said partition plate, wherein when said bill extraction detector detects extraction of bills, said control means moves said pusher plate and said partition plate backward with respect to said front plate.

2. A bill handling machine for handling bills comprising:

a bill input/output part for receiving and paying bills;

a discriminator for discriminating bills;

a plurality of storage cases for storing bills received from said bill input/output part according to discrimination results by said discriminator or storing bills to be paid from said bill input/output part;

a temporary holder for temporarily storing bills received from said bill input/output part;

wherein said bill input/output part includes a pusher plate movably located at a backward stage thereof, a front plate arranged at a forward stage thereof, and a partition plate movably located between said pusher plate and said front plate so that bills transferred from said temporary holder or from said plurality of storage cases are stored between said pusher plate and said partition plate, wherein said bill input/output part further includes control means for varying a distance between said pusher plate and said partition plate according to a number of bills to be stored therebetween; and a bill extraction detector for detecting extraction of bills stored between said pusher plate and said partition plate, wherein when said bill extraction detector detects extraction of bills, said control means makes the distance between said partition plate and said front plate wider than before said bills are extracted.

3. A bill handling machine for handling bills comprising:

a bill input/output part for receiving and paving bills;

a discriminator for discriminating bills;

a plurality of storage cases for storing bills received from said bill input/output part according to discrimination results by said discriminator or storing bills to be paid from said bill input/output part;

a temporary holder for temporarily storing bills received from said bill input/output part;

wherein said bill input/output part includes a pusher plate movably located at a backward stage thereof, a front plate arranged at a forward stage thereof, and a partition plate movably located between said pusher plate and said front plate so that bills transferred from said temporary holder or from said plurality of storage cases are stored between said pusher plate and said partition plate, wherein said bill input/output part further includes control means for varying a distance between said pusher plate and said partition plate according to a number of bills to be stored therebetween; and a bill extraction detector for detecting extraction of bills stored between said pusher plate and said partition plate, wherein if said bill extraction detector does not detect extraction of bills, said control means widens the distance between said pusher plate and said partition plate.

4. A bill handling machine according to claim 3, wherein said control means retracts said pusher plate with respect to said partition plate under the condition that the partition plate is fixed.

5. A bill handling machine for handling bills comprising:

a bill input/output part for receiving and paying bills;

a discriminator for discriminating bills;

a plurality of storage cases for storing bills received from said bill input/output part according to discrimination results by said discriminator or storing bills to be paid from said bill input/output part;

a temporary holder for temporarily storing bills received from said bill input/output part;

wherein said bill input/output part includes a pusher plate movably located at a backward stage thereof, a front plate arranged at a forward stage thereof, and a partition plate movably located between said pusher plate and said front plate so that bills transferred from said temporary holder or from said plurality of storage cases are stored between said pusher plate and said partition plate, wherein said bill input/output part further includes control means for varying a distance between said pusher plate and said partition plate according to a number of bills to be stored therebetween; and a failure-to-extract detector for detecting failure to extract bills stored between said pusher plate and said partition plate, wherein when said failure-to-extract detector detects a failure to extract bills, said control means makes the distance between said pusher plate and said partition plate wider than before said failure to extract is detected.

6. A bill handling machine according to claim 5, wherein said control means retracts said pusher plate with respect to said partition plate under the condition that the partition plate is fixed.

7. A bill handling machine for handling bills, comprising:

a bill input/output part including a bill input space for stacking bills to be received and a bill output space for stacking bills to be returned;

a discriminator for discriminating bills;

a temporary holder for temporarily storing bills to be transferred from said bill input/output part through said discriminator;

control means for making said bill input space of said bill input/output part wider than before said bills are extracted after said bills are transferred from said temporary holder to said bill output space of said bill input/output part and said transferred bills are extracted from said bill output space; and a bill extraction sensor for detecting extraction of bills from said bill output space.

8. A bill handling machine for handling bills, comprising:

a bill input/output part including a bill input space for stacking bills to be received and a bill output space for stacking bills to be returned or paid;

a discriminator for discriminating bills;

a temporary holder for temporarily storing bills transferred from said bill input/output part through said discriminator;

a plurality of storage cases for storing bills received from said bill input/output part or bills to be paid from said bill input/output part; and control means for making said bill output space wider than when bills are transferred when bills transferred from said temporary holder or from said plurality of storage cases are transferred to said bill output space of said bill input/output part and a failure to extract said transferred bills is detected.

9. A bill handling machine according to claim 8, wherein said bill input space is formed between a front plate located at a forward stage of said bill input/output part and a partition plate movably located at a middle stage of said bill input/output part, and wherein said bill output space is formed between a pusher plate movably located at a backward stage of said bill input/output part and said partition plate.

10. A bill handling machine according to claim 9, wherein said control means makes said bill output space wider by moving said pusher plate backward with respect to said partition plate.

11. A bill handling machine according to claim 8, further comprising a first sensor for detecting a failure to extract a bill from said bill output space, and a second sensor for detecting that the bill that failed to be extracted from said bill output space does not measure up to a regular size.

12. A bill handling machine according to claim 11, wherein a decision is made that there is a bill that failed to be extracted in said bill output space when said first sensor detects the darkness and said second sensor detects the darkness.

13. A bill handling machine according to claim 11, wherein a decision is made that there is a bill that failed to be extracted in said bill output space when said first sensor detects the darkness and said second sensor detects light.

* * * * *